United States Patent [19]

Watanabe

[11] 4,449,449

[45] May 22, 1984

[54] DATA STAMP DEVICE FOR AUTOMATIC PRINTING APPARATUS OF COPIER

[75] Inventor: Yutaka Watanabe, Kanagawa, Japan

[73] Assignee: Fuji Xerox Co., Ltd., Tokyo, Japan

[21] Appl. No.: 390,603

[22] Filed: Jun. 21, 1982

[30] Foreign Application Priority Data

Aug. 5, 1981 [JP] Japan ..... 56-121798

[51] Int. Cl.[3] ..... B41J 1/60

[52] U.S. Cl. ..... 101/111; 101/327; 101/93.13

[58] Field of Search ..... 101/93.13, 93.14, 111, 101/327, 338, 348, 359, 93.47, 94, 98, 105

[56] References Cited

U.S. PATENT DOCUMENTS

| | | | |
|---|---|---|---|
| 641,651 | 1/1900 | Snowman | 101/93.13 |
| 2,807,999 | 10/1957 | Koeber, Jr. | 101/111 X |
| 2,831,424 | 4/1958 | MacDonald | 101/111 X |
| 2,950,048 | 8/1960 | Luhn | 101/93.13 X |
| 3,682,282 | 8/1972 | Carboni et al. | 101/111 X |
| 3,774,532 | 11/1973 | McKay | 101/111 |
| 3,951,061 | 4/1976 | Bremmer, Jr. et al. | 101/111 X |
| 4,084,507 | 4/1978 | Sato | 101/111 X |
| 4,127,065 | 11/1978 | Rybczyk | 101/93.14 X |
| 4,170,938 | 10/1979 | Sato | 101/111 |
| 4,292,893 | 10/1981 | Kirby, Jr. | 101/111 |

FOREIGN PATENT DOCUMENTS

| | | | |
|---|---|---|---|
| 2729097 | 1/1978 | Fed. Rep. of Germany | 101/111 |
| 878495 | 10/1961 | United Kingdom | 101/93.13 |

*Primary Examiner*—E. H. Eickholt

*Attorney, Agent, or Firm*—Sughrue, Mion, Zinn, Macpeak, and Seas

[57] ABSTRACT

A data stamp unit has a plurality of belts with seals thereon mounted in the unit so that a seal on each of the belts projects on an arcuately-shaped opening in the unit. The seals are also arcuately shaped. A push roller in the unit is rotated synchronously towards a copying paper as the copying paper is transported through a copier so that the copying paper is momentarily clamped between the seals and the push roller, which results in the copying paper being stamped appropriately.

14 Claims, 18 Drawing Figures

DATA STAMP DEVICE FOR AUTOMATIC PRINTING APPARATUS OF COPIER

BACKGROUND OF THE INVENTION

The present invention relates to a swiveling data stamp, for an automatic printing apparatus of a copier, for printing on the surface of a copying paper.

SUMMARY OF THE INVENTION

According to the present invention, a data stamp unit is selectively rotatably mounted about a first swivel shaft so that seals located on belts supported in said data stamp unit can selectively engage a copying paper as the latter is transported through a copier. The seals project from an opening in the data stamp unit, and the seals and the opening are curved, the center of curvature being the first swivel shaft. A second swivel shaft is coupled to a driving system of the copying paper, and the second swivel shaft is interconnected with the first swivel shaft, an idler shaft and a third swivel shaft by a plurality of pulleys and corresponding belts as well as by various link mechanisms. When the copying paper reaches a desired position in the copying machine, the second swivel shaft swivels, thus causing the data stamp unit to swivel so that it contacts and stamps the copying paper. At the same time, a push roller is caused to move upward and, in conjunction with the seals, clamps the copying paper as it is stamped.

DESCRIPTION OF THE PREFERRED EMBODIMENTS

Figure 1:
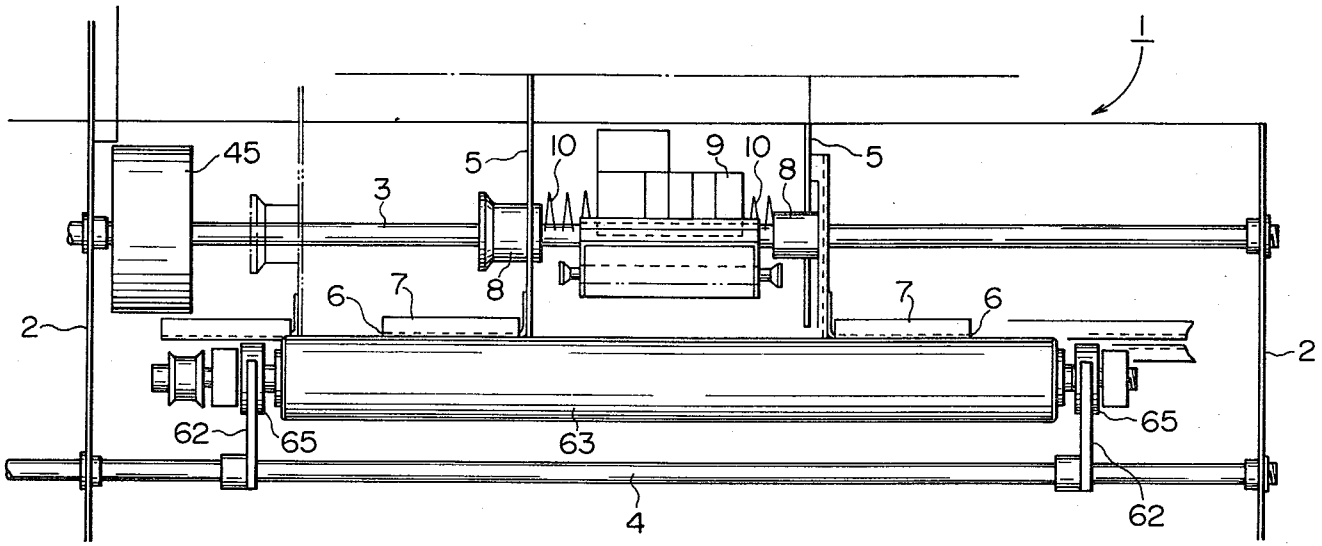
FIG. 1 is a schematic front view showing one embodiment of a data stamp device, incorporated in an automatic printing apparatus of a copier, according to the present invention.
Figure 2:
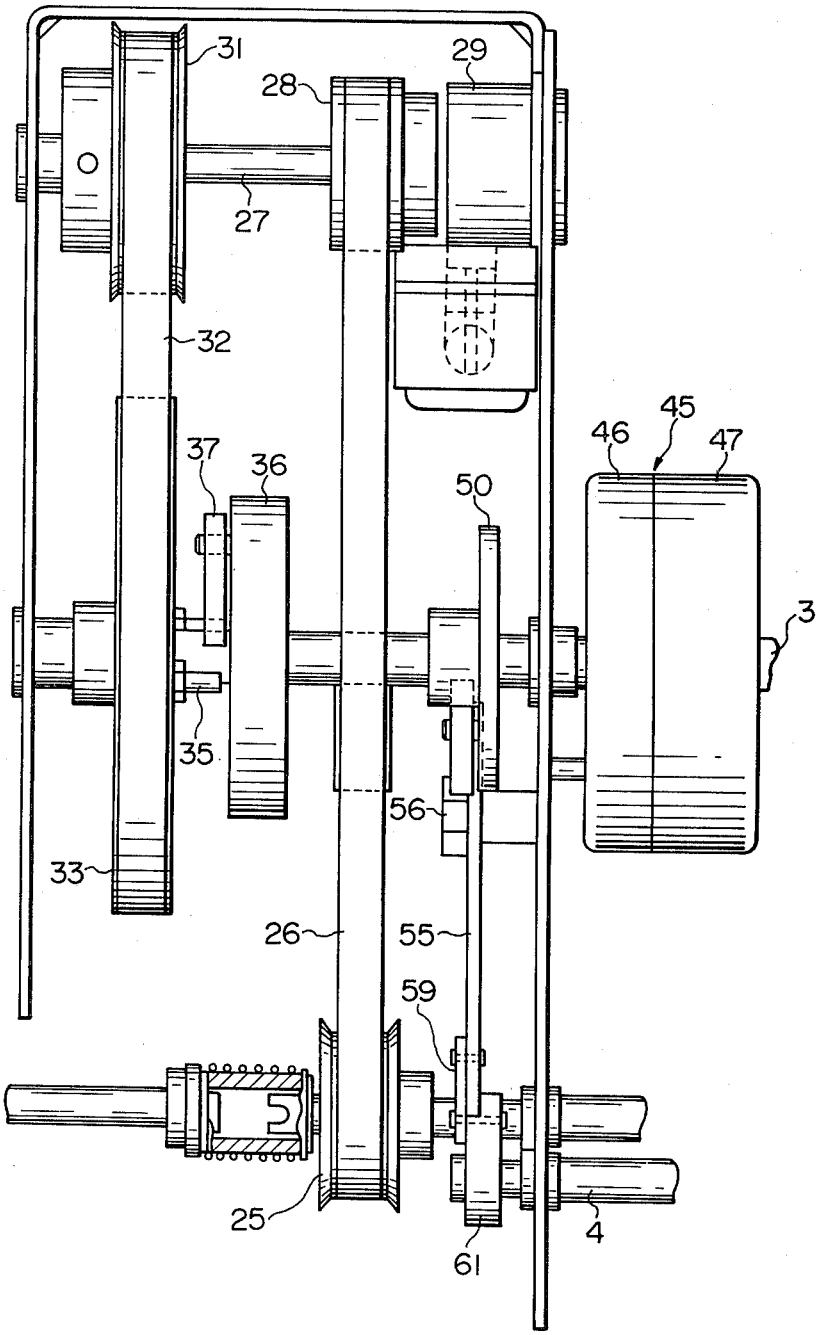
FIG. 2 is a front view of the left side portion of FIG. 1.
Figure 4:
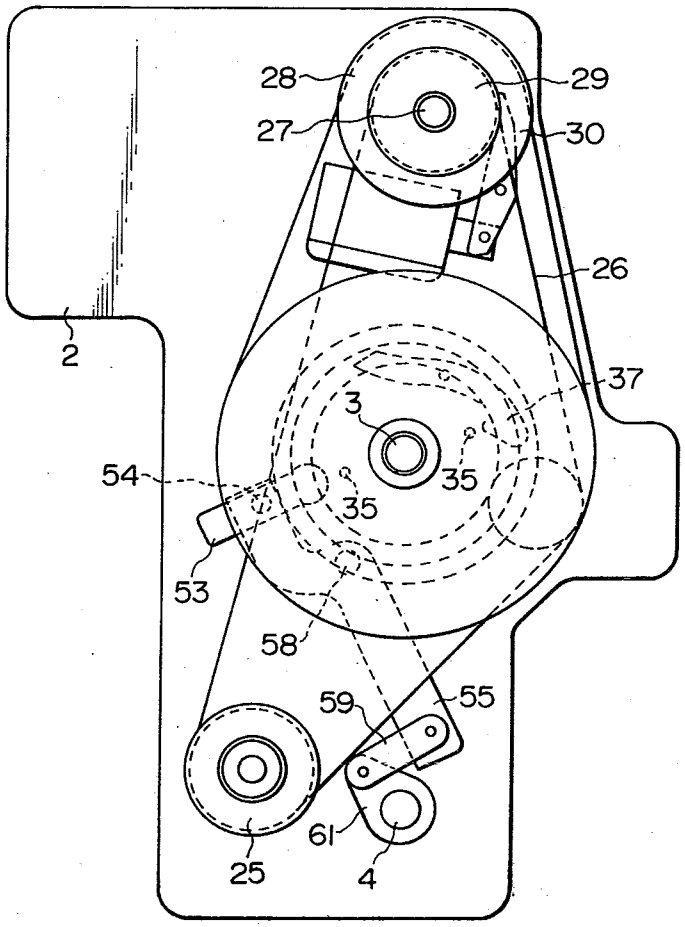
FIG. 4 is a left side view of FIG. 1.

In FIG. 1, an automatic printing apparatus 1 is disposed nearer to an outlet of a copier (not shown) than a fixing apparatus of the copier. Both ends of a data stamp unit swivel shaft 3 and a stamper cam shaft 4 are pivotally supported on opposite frame side plates 2 of the automatic printing apparatus. A longitudinal axis of the swivel shaft 3 is perpendicular to a direction of travel, indicated by the arrow X in FIG. 3, of a copying paper 0. The central portion of the swivel shaft 3 is square in section, and the stamper cam shaft 4 is positioned parallel to and just under the swivel shaft 3.

A supporting shaft (not shown) is positioned above and parallel to the swivel shaft 3. The supporting shaft is fixed on the frame side plate 2 so that it is integral therewith. A holder (not shown) is slidably mounted on the supporting shaft and fixed on an endless chain (not shown) which runs parallel to the supporting shaft. One of a pair of sprockets for supporting the chain is fitted for lateral movement in a rotary shaft (not shown) of a motor. The motor is turned and reversed in response to a control signal generated from a control unit (not shown), and the control signal forces the holder to move from side to side parallel to the longitudinal axis of the swivel shaft 3.

Figure 3:
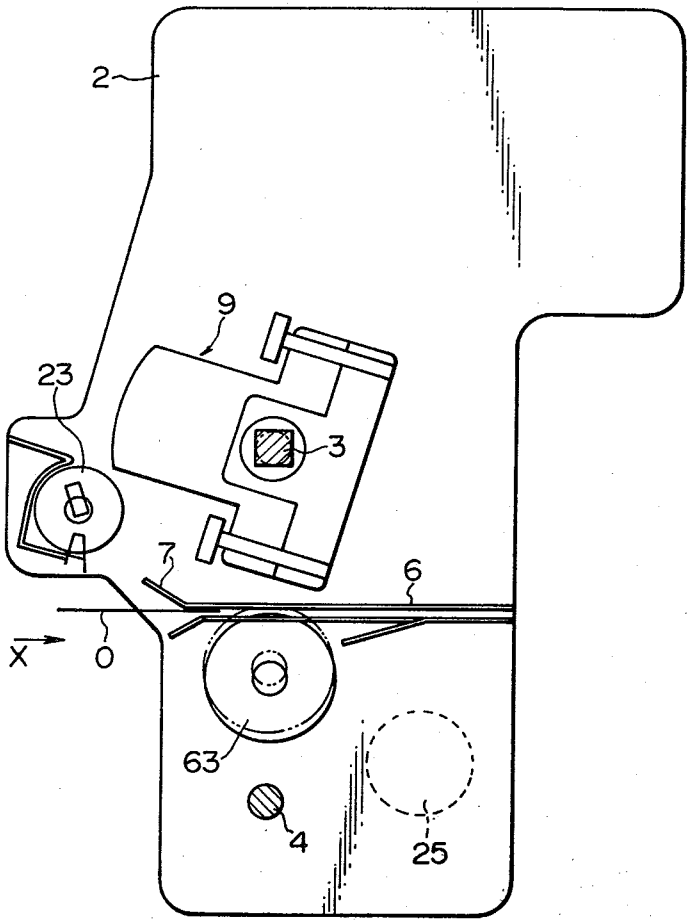
FIG. 3 is a right side view of FIG. 1.

The holder is formed with supporting side plates 5 hanging down from both side ends of the holder. The lower ends of both supporting side plates 5 are provided with a preventing plate 6 which prevents the copying paper 0 from jumping. The preventing plate extends outward from the apparatus, as seen in FIG. 1. A guide edge portion 7 of the preventing plate 6 is located close to the fixing apparatus and is bent so that it points diagonally upward toward the fixing apparatus, as shown in FIG. 3.

A pair of pivoting portions 8 slidably support the swivel shaft 3 and are rotatably fitted in the two supporting side plates 5, as illustrated in FIG. 1. A data stamp unit 9 is slidably mounted on the swivel shaft 3 between the pivoting portions 8. Coil springs 10 are interposed between the pivoting portions 8 and the sides of the data stamp unit 9. When the supporting side plates 5 are moved from side to side by movement of the holder (not shown), the data stamp unit 9 also moves from side to side through the coil springs 10.

Figure 5:
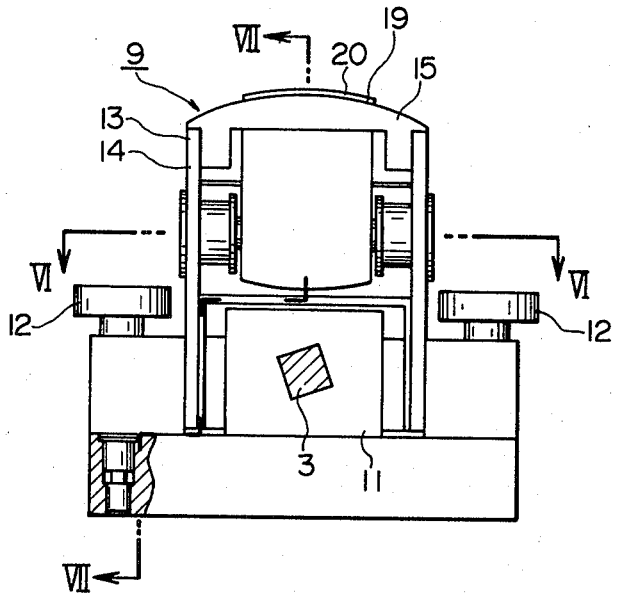
FIG. 5 is a side view of the data stamp device.
Figure 6:
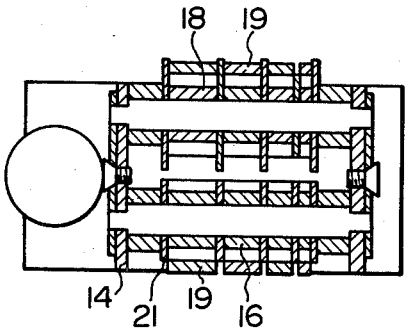
FIGS. 6 and 7 are sectional views along line VI—VI and line VII—VII of FIG. 5, respectively.
Figure 7:
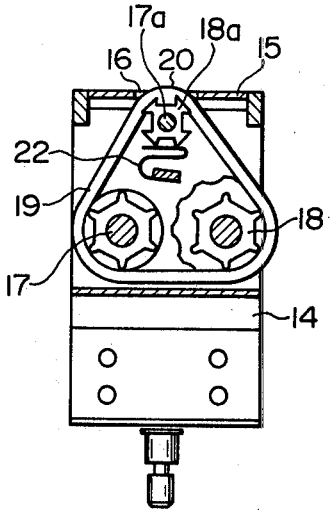

The data stamp unit 9, shown in FIGS. 5–7, comprises a convex base portion 11; a gate-shaped case 13 detachably mounted on opposite ends of the base portion 11 by fixing screws 12; three shafts 17, **17*a*, two of which (17, 17) are in lower sections of both side portions 14 of the gate-shaped case 13 while the third shaft 17*a* is fitted in the upper sections of the side portion 14, the shafts 17, 17*a* extending perpendicular to the longitudinal axis of the swivel shaft 3; four pairs of pulleys 18, 18*a* arranged and axially spaced apart on the shafts 17; four endless belts 19 formed of elastic material such as rubber and stretched between the pulleys 18, 18*a*; partition plates 21 interposed between the endless belts 19; and a spring 22 for elastically fixing the pulley 18*a* which is mounted on the upper shaft 17*a*. The top portion 15 of the gate-shaped case 13 is provided with an opening 16. A plurality of designs, initials, letters, marks, etc., hereinafter referred to as seals and identified as reference number 20, are located on the surface of the endless belts 19 and project slightly out of the opening 16 outside of the top portion 15, as shown in FIG. 7**.

Figure 11:
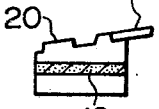

The periphery of the top portion 15 of the gate-shaped case 13 and the surface of the seals 20 of the endless belts 19 are arc shaped (see FIG. 11 for details), the radius of curvature of the top portion 15 and the seals 20 being equal to the distance between the elements 15, 20 and the swivel shaft 3, as shown in FIG. 5.

Referring to FIG. 3, an ink supply roll 23 is pivotally mounted adjacent the fixing apparatus, and the data unit 9 is located adjacent the ink supply roll 23. The ink supply roll 23 is adapted to supply and adhere ink to the surface of the seal 20 when the data stamp unit 9 is moved downward. The left-most frame side plate 2, as shown in FIG. 1, has a mechanism 45 for reciprocating the swivel shaft 3 attached at an outside portion thereof.

Figure 12:
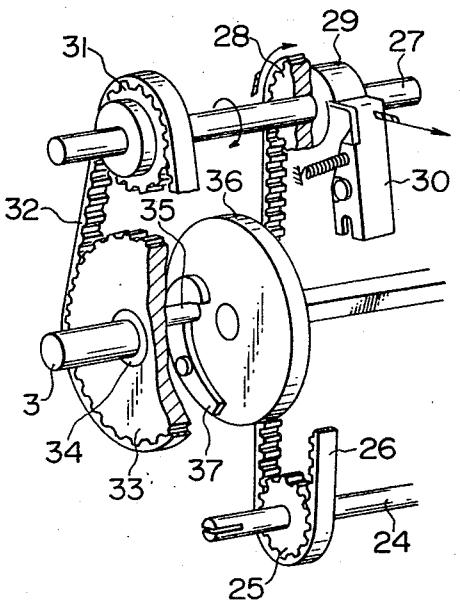
FIG. 12 is a perspective view of a clutch mechanism with a part broken away for use with the device of the invention.
Figure 8:
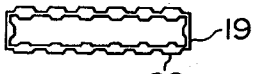
FIG. 8 is a side view of an endless belt shown in FIGS. 5–7.
Figure 9:
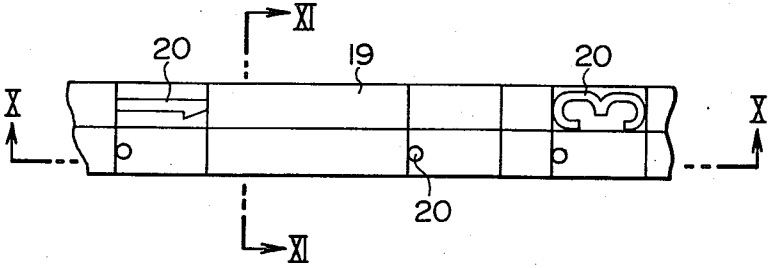
FIG. 9 is a plane view of the belt shown in FIG. 8.
Figure 10:
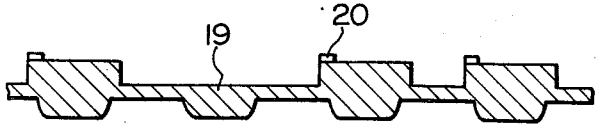
FIGS. 10 and 11 are sectional views along line X—X and line XI—XI of FIG. 9, respectively.

As best seen in FIG. 12, a pulley 25 is mounted on a swivel shaft 24 and is coupled to a driving system for moving the copying paper (not shown). An idler pulley 28 is loosely mounted on an idler shaft 27 which is positioned parallel to the swivel shaft 24. A belt 26 is stretched between the pulley 25 and the idler pulley 28. A spring clutch 29 is positioned adjacent to the idler pulley 28 and is formed with the idler shaft 27. While the spring clutch 29 is stopped with a latch 30, the turning force of the swivel shaft 24 is not transmitted to the idler shaft 27, and, when the latch 30 is detached from the spring clutch 29, the turning force of the swivel shaft 24 is transmitted to the idler shaft 27 through the pulley 25, the belt 26, the idler pulley 28, and the spring clutch 29.

A second pulley 31 is mounted on the idler shaft 27, and a second belt 32 is stretched between the pulley 31 and a pulley 33. The diameter of the pulley 33 is twice the diameter of the pulley 31. The pulley 33 is pivotally supported on the swivel shaft 3 through a bearing 34.

Figure 13:
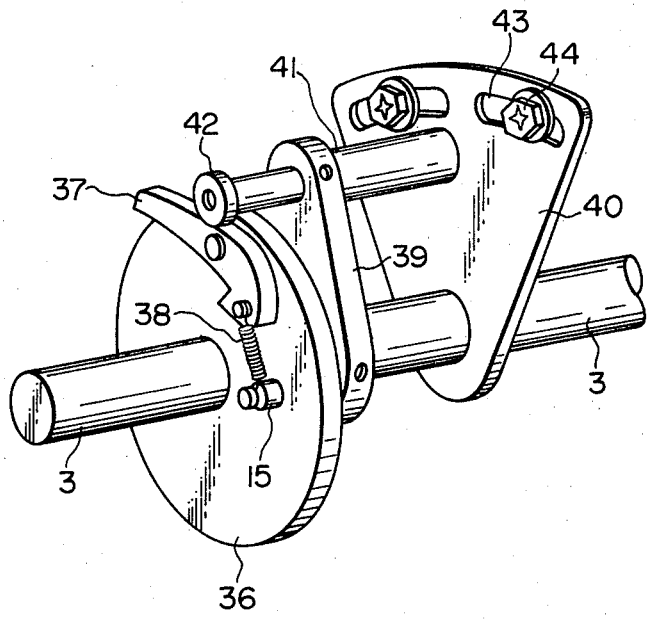
FIG. 13 is a perspective view illustrating a detached portion of the clutch mechanism of FIG. 12.
Figure 14:
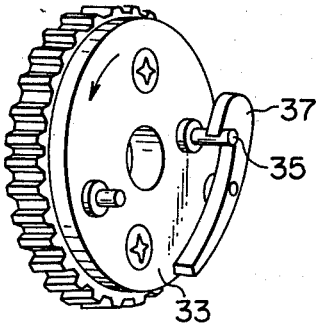
FIG. 14 is a perspective view illustrating the engaging relationship between a pin and a latch in the clutch mechanism of FIGS. 12 and 13.

As shown in FIG. 14, two pins 35 project from the inside surface of the pulley 33. A clutch plate 36 is positioned adjacent to the inside surface of the pulley 33 and is integral with the swivel shaft 3. A latch 37 is freely pivotally mounted on the outside surface of the clutch plate 36 and is adapted to be engaged with the pin 35. As shown in FIG. 13, a spring 38 is extended so that the latch 37 is engaged with the pin 15.

A supporting plate 39 and an adjusting plate 40 are rotatably mounted on the swivel shaft 3 and are positioned inside the clutch plate 36. The supporting plate 39 and the adjusting plate 40 are connected to each other by an adjusting shaft 41, the outer end of which is provided with a bearing 42 for detaching the latch 37 from the pin 35. The adjusting plate 40 is formed with a pair of arc grooves 43, and the swivel shaft 3 is centered below the arc grooves (see FIG. 15). Thus, the adjusting plate 40 is fixed in a proper position with bolts which pass through the arc grooves 43. The bolts are threaded on the frame side plate 2 so that the timing of detachment of the latch 37 from the pin 35 can be adjusted properly.

A returning device 45 (FIGS. 15, 16) is disposed adjacent the adjusting plate 40. The device 45 comprises a pair of couplings 46, 47 and coil springs 49, both ends of which are fixed on the couplings 46, 47 by screws 48 in the interior of the couplings 46, 47. One of the couplings 46 is fixed on the adjusting plate 40 or on the frame side plate 2, and the other coupling 47 is rotatably mounted on the swivel shaft 3.

A stamper actuating cam 50 is positioned on the swivel shaft 3 outside of the frame side plate 2 and inside of the belt 26 and is connected to the shaft 4 via a link mechanism 51 so that the rotation of the stamper actuating cam 50 causes the shaft 4 to swivel.

Figure 17:
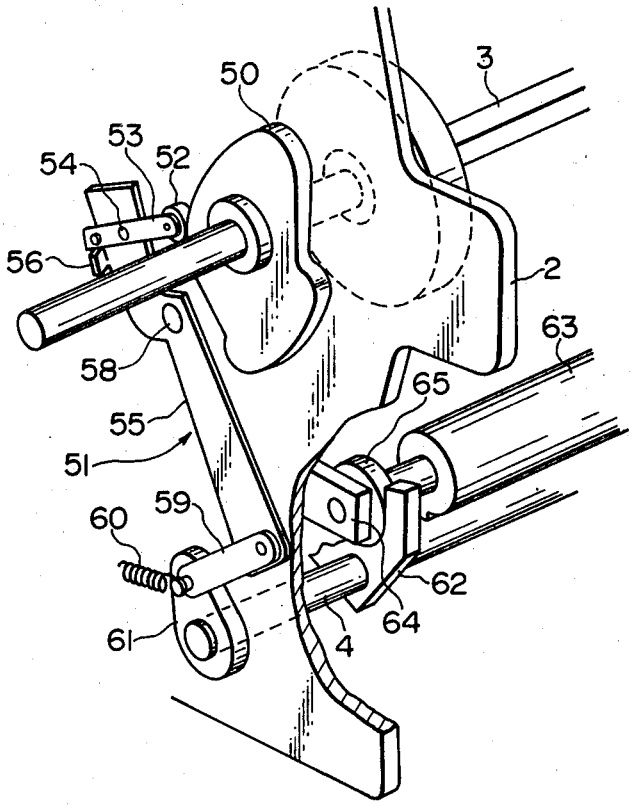
FIG. 17 is a perspective view illustrating a stamper actuating mechanism with a part broken away.

Referring to FIG. 17, in the above-mentioned link mechanism 51, a release lever 53 for pivotally supporting a roller 52 contacting the stamper actuating cam 50, is freely pivotally supported on a main link 55 through a pin 54. A spring 57 extends between the release lever 53 and the main link 55 so that the release lever 53 is urged counterclockwise to come into contact with a stopper 56 in FIGS. 17 and 18. The main link 55 is freely pivotally mounted on the frame side plate 2 by a support pin 58. The lower end of the main link 55 is connected to a bell crank 61 by a rod 59, the bell crank 61 being integral with the stamper cam shaft 4. A return spring 60 extends between the bell crank 61 and the frame side plate 2 and urges the stamper cam shaft 4 to move counterclockwise, as shown in FIG. 17.

The stamper cam shaft 4 is formed with a force cam 62, and a support lever 64 rotatably supports a rubber stamper roller 63 which acts as a push roller. The support lever is pivotable so that it freely moves up and down. A cam follower 65 is pivoted on the rotary shaft of the stamper roller 63 and is in contact with the force cam 62. As FIG. 17 shows, when the convex arc of the stamper actuating cam 50 is pressed against the roller 52 so that it moves the stamper cam shaft 4 clockwise, the convex arc of the force cam 62 pushes the stamper roller 63 upward.

Figure 15:
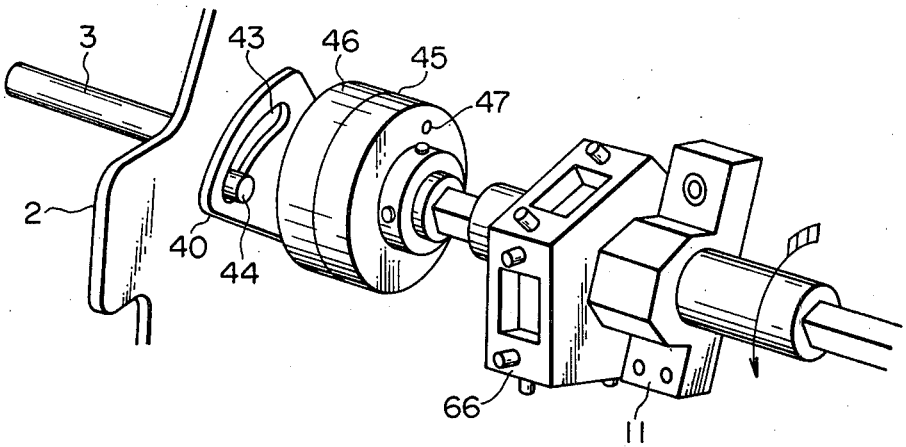
FIG. 15 is a perspective view illustrating a returning device for use with the device of the present invention.
Figure 16:
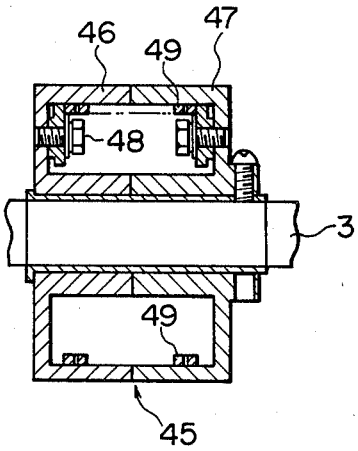
FIG. 16 is a longitudinal sectional front view of the returning device of FIG. 15.

Referring to FIG. 15, a regular, pentagonal changeover data stamp unit 66 is disposed adjacent to the data stamp unit 9, and the data stamp is rotatable through an arc of 72 degrees. The position of the unit 66 is fixed as occasion demands so that it makes an appropriate date stamp.

The embodiment of the automatic printing apparatus 1, according to the present invention illustrated in the drawings, is formed as described above. Therefore, if the motor (not shown) for imparting a lateral movement in the longitudinal direction of the swivel shaft 3 is properly turned or reversed to stop the data stamp unit 9, the data stamp unit 9 is guided and supported by the data stamp unit swivel shaft 3 and can be suitably set at a desired printing position along the widthwise direction of the copying paper 0.

The copied copying paper 0 arrives at the automatic printing apparatus 1 and then passes below the data stamp unit 9. The latch 30 is released when it is detected that the copied paper 0 has reached a position directly in front of a printing position along a transporting direction of the copying paper 0. The turning force of the driving shaft 24 is then transmitted to the pulley 33 through the pulley 25, the belt 26, the idler pulley 28, the spring clutch 29, the idler shaft 27, the pulley 31 and the belt 32 so that the pulley 33 is driven to rotate clockwise, as shown in FIG. 12.

As the pulley 33 rotates clockwise, the pin 35 of the pulley 33 immediately engages the latch 37 which causes the clutch plate 36 to rotate clockwise, see FIGS. 12–14. The rotation of the clutch plate 36 is transmitted to the data stamp unit 9 through the swivel shaft 3 so that the data stamp unit 9 is moved clockwise from an angled position, as indicated in FIG. 3.

Figure 18:
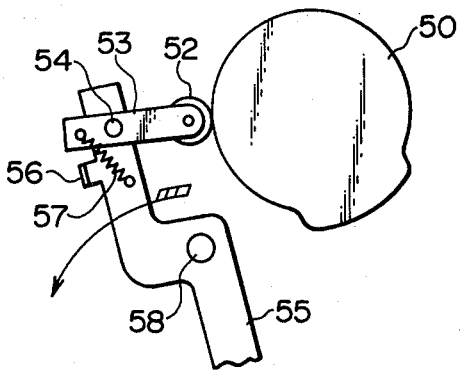
FIG. 18 is a side view of the main portion of the stamp actuating mechanism of FIG. 17.

Just before the seal 20 of the data stamp unit 9 is brought into close proximity with the copying paper 0, the stamper actuating cam 50, which is connected to the swivel shaft 3, is turned clockwise so that it comes into contact with the roller 52 at the convex arc thereof, as shown in FIGS. 17 and 18. Since the release lever 53 is engaged with the stopper 56, the release lever is pushed to the left in FIGS. 17 and 18 which causes the main link 55 to move counterclockwise about the support pin 58. The rotation of the main link 55 causes the bell crank 61, the stamper cam shaft 4 and the force cam 62 to rotate clockwise via the rod 59 connection, as shown in FIG. 17. The stamper roller 63 is then pushed upward by the force of the convex arc of the force cam 62. Therefore, the upward movement of the stamper roller 63 is synchronous with the swivel of the data stamp unit 9. Thus, the copying paper 0 is clamped by both the roller 63 and the data stamp unit, and the seal 20 of the data stamp unit 9 is pressed against the surface of the copying paper 0 so that the required data are printed on the surface of the copying paper 0.

At the point in time when the swivel shaft 3 is moved through a 160 to 165 degree arc, the back part of the latch 37 is brought into pressure contact with the roller 42 of the adjusting shaft 41 and moved downward. This downward movement causes the latch 37 to detach from the pin 35 so that it cuts off the turning force transmitted from the pulley 33 to the swivel shaft 3. Thus, the spring force of the coil spring 49 of the returning device 45 causes the swivel shaft 3 to rotate in the opposite direction through the rotary coupling 47, and the data stamp unit 9 is automatically restored to the position indicated in FIG. 3.

In this case, as the roller 52 passes the convex arc of the stamper actuating cam 50 as the cam 50 rotates counterclockwise with the return movement of the swivel shaft 3, the roller 52 is again pushed by the convex arc of the stamper actuating cam 50. However, the roller 52 is pushed downward in FIGS. 17 and 18 to move the release lever 53 clockwise so that the cam action of the stamper actuating cam 50 is not transmitted to the stamper cam shaft 4. The stamper roller 63, lowered in the extreme situation of printing completion of the data stamp unit 9, is still retained at a lowered position, and, thus, when the data stamp unit 9 is moved and restored, the seal 20 will not contact the copying paper 0, and the stain on the surface of the copying paper 0 caused by contacting the seal can be prevented beforehand.

Further, as the four endless belts 19 are separated with partition plates 21 which are parallel to the swivel shaft 3, and the seals 20 are formed on the surface of each endless belt 19, four kinds of printings such as year, month, day and the like, can be arranged and stamped on the copying paper 0 along its transverse direction.

A variety of printing seals such as 1, 2, 3, . . . or A, B, C and the like can be formed on the surface of each endless belt 19. The required printing seals can be freely selected to protrude from the opening of the data stamp unit by rotating and moving the four endless belts 19 separately.

As the surface of the seals 20 of the endless belt 19 is formed on the arc surface of a circle centered about the swivel shaft 3, at the time of printing on the surface of the copying paper 0 by movement of the data stamp unit 9, the vertical positional relationship of the seals 20 with the copying paper 0 is always retained constant so that a uniform printing is achieved.

The present invention is described in detail above by way of one embodiment illustrated in the drawings; however, the invention is not limited to such an embodiment, and it can be subject to a free and proper change of design as occasion demands within the scope of the spirit of the invention.

I claim:

1. A data stamp device for an automatic printing apparatus of a copier, comprising:

a data stamp unit having an opening on a surface thereof;

at least one endless belt having a plurality of seals thereon;

means for mounting and driving said at least one endless belt within said unit so that a desired seal projects out of said opening;

means for swiveling said data stamp unit so that said desired seal comes in contact with a sheet, said swiveling means including;

a first swivel shaft about which said data stamp unit swivels;

a second swivel shaft coupled to a driving system which moves said sheet through said copier;

an idler shaft;

a plurality of belt and pulley means for interconnecting said first and second swivel shafts and said idler shaft; and clutch plate means disposed on said first swivel shaft and being selectively engageable with one of said plurality of belt and pulley means to selectively transmit rotation of said second swivel shaft to said first swivel shaft.

2. The device claimed in claim 1 wherein a plurality of endless belts are mounted and driven so that a desired seal on each of said belts projects out of said opening along a length thereof, said opening being arcuately shaped along said length thereof, and said seals being arcuately shaped, a radius of curvature of said seals being equal to a radius of curvature of said opening.

3. The device claimed in claim 2 wherein said data stamp unit comprises:

a convex base portion;

a gate-shaped case detachably mounted on opposite ends of said convex base portion;

a plurality of shafts and a plurality of sets of pulleys disposed on said shafts for mounting and driving said belts; and a plurality of partition plates interposed between adjacent sets of pulleys.

4. The device claimed in claim 1 further comprising means for moving said data stamp unit along a longitudinal direction of said first shaft.

5. The device claimed in claim 4 further comprising an ink supply roll for supplying ink to said seals as said data stamp unit is swiveled toward said sheet.

6. The device claimed in claim 1 wherein said swiveling means further includes returning means for swiveling said first swivel shaft after said seals have contacted said sheet.

7. The device claimed in claim 6 further comprising a push roller for selectively clamping said copying paper as said desired seal on said data stamp unit contacts said sheet; and means for moving said push roller towards and away from said copying paper.

8. The device claimed in claim 7 wherein said moving means comprises:

a stamper actuating cam located on said first swivel shaft;

link mechanism means actuated by said stamper actuating cam for transmitting movement of said stamper actuating cam to a third swivel shaft;

a force cam located on said third swivel shaft and rotatable therewith; and means responsive to said rotation of said force cam for moving said push roller.

9. The device claimed in claim 8 wherein said link mechanism includes means for preventing said transmission of movement of said stamper actuating cam to said third swivel shaft when said returning means swivels said first swivel shaft after said seals have contacted said copying paper.

10. The device as claimed in claim 1, wherein said first and second swivel shafts and said idler shaft are substantially parallel to one another.

11. The device as claimed in claim 1, wherein said swiveling means further include a spring clutch connected to said idler shaft, a latch selectively engageable with said spring clutch, and means for determining a position of said sheet immediately in front of a data stamp printing position, which detecting means disengages said latch from said spring clutch upon detection of said position.

12. The device as claimed in claim 1, wherein said clutch plate means comprises a clutch plate disposed on said first swivel shaft, said clutch plate having a latch thereon selectively engageable with a pin on one of said plurality of pulley means, and means for disengaging said latch from said pin after a predetermined angular rotation of said first swivel shaft.

13. The device as claimed in claim 12, wherein said disengaging means comprises a roller disposed on a roller shaft fixedly mounted and parallel to said first swivel shaft.

14. The device as claimed in claim 12, wherein said swiveling means further includes returning means for swiveling said first swivel shaft after said seals have contacted said sheet and said latch has been disengaged from said pin.

* * * * *